United States Patent [19]

Futakami

[11] Patent Number: 5,050,590

[45] Date of Patent: Sep. 24, 1991

[54] APPARATUS FOR PRACTICE OF AMBULATION

[75] Inventor: Kazuhiko Futakami, Shizuoka, Japan

[73] Assignee: Japan Em Co., Ltd., Shizuoka, Japan

[21] Appl. No.: 401,088

[22] Filed: Aug. 31, 1989

[30] Foreign Application Priority Data

Sep. 2, 1988 [JP] Japan ..... 63-219867

[51] Int. Cl.[5] ..... A61H 1/02

[52] U.S. Cl. ..... 128/25 R; 272/70; 901/48; 212/195; 414/719

[58] Field of Search ..... 272/70, 70 A, 70.3, 272/70.4; 901/9, 17, 18, 48; 212/195; 414/921, 719; 364/513; 128/25 R

[56] References Cited

U.S. PATENT DOCUMENTS

| | | | |
|---|---|---|---|
| 2,631,582 | 3/1953 | Bersfield | 128/25 R |
| 4,229,136 | 10/1980 | Parissidi | 414/719 X |
| 4,421,450 | 12/1983 | Kouno | 414/719 |
| 4,443,902 | 4/1984 | Baer | 272/70.4 X |
| 4,664,584 | 5/1987 | Braun et al. | 414/921 X |
| 4,765,410 | 8/1988 | Sidwell | 272/117 |

FOREIGN PATENT DOCUMENTS 63-96014 6/1988 Japan .

*Primary Examiner*—Richard J. Apley
*Assistant Examiner*—Joe H. Cheng
*Attorney, Agent, or Firm*—Helfgott & Karas

[57] ABSTRACT

An apparatus adapted for practice of ambulation is provided in which a suspending arm for suspending a patient at a point in the distal portion is supported at a fulcrum, a force to balance the load based on the suspended patient is conveyed to the suspending arm on the side of, or opposite to the suspending point with respect to the fulcrum. A vertical rod is actuated by a force producing means in the vertical direction and the vertical rod is engaged with the suspending arm in the proximate portion thereof by an engaging means, which converts the vertical motion of the vertical rod to the pivoting motion of the suspending arm around the fulcrum. The suspending arm is prevented from longitudinal shift. The apparatus is adapted for assisting the patient in walking, preventing the patient from wobbling.

7 Claims, 7 Drawing Sheets

APPARATUS FOR PRACTICE OF AMBULATION

FIELD OF THE INVENTION

The invention relates to an apparatus for practice of ambulation, and more particularly to an apparatus for practice of ambulation adapted for assisting a person who finds it hard to walk in the practice of ambulation, thereby improving the walking ability.

BACKGROUND OF THE INVENTION

An apparatus for practice of ambulation has been proposed in Japanese Utility Model Kokai No. 63-96014, in which a horizontal arm is provided for suspending a person who finds it hard to walk (called "patient" hereinafter) at the distal end, two upright rods are connected at their ends to the proximate portion of the horizontal arm, a short rod is connected to the lower ends of the upright rods so that the four members form a parallelogram, the inner upright rod placed closer to the patient is pivoted at a point in the lower part thereof so as to permit the rod to rotate in the plane including the horizontal arm, and the other upright rod is connected at the lower end to a piston/cylinder unit having a piston for pulling down the rod vertically and a cylinder capable of shifting horizontally. The whole of the apparatus, thus the horizontal arm, is rotatable about the inner upright rod so that the patient suspended by the apparatus can walk around the rod. The patient's walking corresponds to the movement transverse to the horizontal arm. The patient's wobbling corresponds to the movement along the horizontal arm. If the patient wobbles while walking, the horizontal arm suspending the patient shifts longitudinally and the two upright rods are inclined slightly. The inclination of the upright rods causes the piston/cylinder unit to shift horizontally, as such shift is permitted. Thus, the apparatus allows the patient to wobble while walking.

However, the nature of the apparatus allowing the patient to wobble is a disadvantage from the point of view of assisting a patient in the practice of ambulation, because the patient cannot be recovered from the wobbling by the help of the apparatus.

Moreover, the complex structure of the apparatus which permits the inclination of the two upright rods supporting the horizontal arm, keeping the parallel relation, is attended with high costs. The mechanism permitting the horizontal shift of the piston/cylinder unit is desired to be substantially free from frictional resistance, therefore greater precision of the mechanism is required, resulting in higher cost.

SUMMARY OF THE INVENTION

Accordingly, it is an object of the invention to provide an apparatus for practice of ambulation which prevents a patient subjected to the practice from wobbling during walking.

It is a further object of the invention to provide an apparatus for practice of ambulation simplified in structure and capable of manufacture at lower cost.

According to the invention, an apparatus for practice of ambulation comprises:

a suspending arm pivotable around a fulcrum for suspending a patient at a point in the distal portion;

means for producing a force which causes the suspending arm to balance against a load based on the weight of the patient;

a vertical rod connected to the force producing means and actuated thereby in the vertical direction; and means for engaging the vertical rod with the suspending arm in the proximate portion thereof;

wherein the engaging means converts the vertical motion of the vertical rod to the pivoting motion of the suspending arm around the fulcrum to convey the force applied to the vertical rod by the force producing means to the suspending arm, without horizontal shift of the vertical rod.

The suspending arm for suspending the patient in the distal portion may be pulled down by the force conveyed by the engaging means on the side opposite to the suspending point with respect to the fulcrum so as to balance the load applied to the suspending arm, or may be lifted up on the same side as the suspending point with respect to the fulcrum.

BRIEF DESCRIPTION OF THE DRAWINGS

The invention will be explained in more detail in conjunction with following drawings wherein.

DESCRIPTION OF THE PREFERRED EMBODIMENTS

Figure 1:
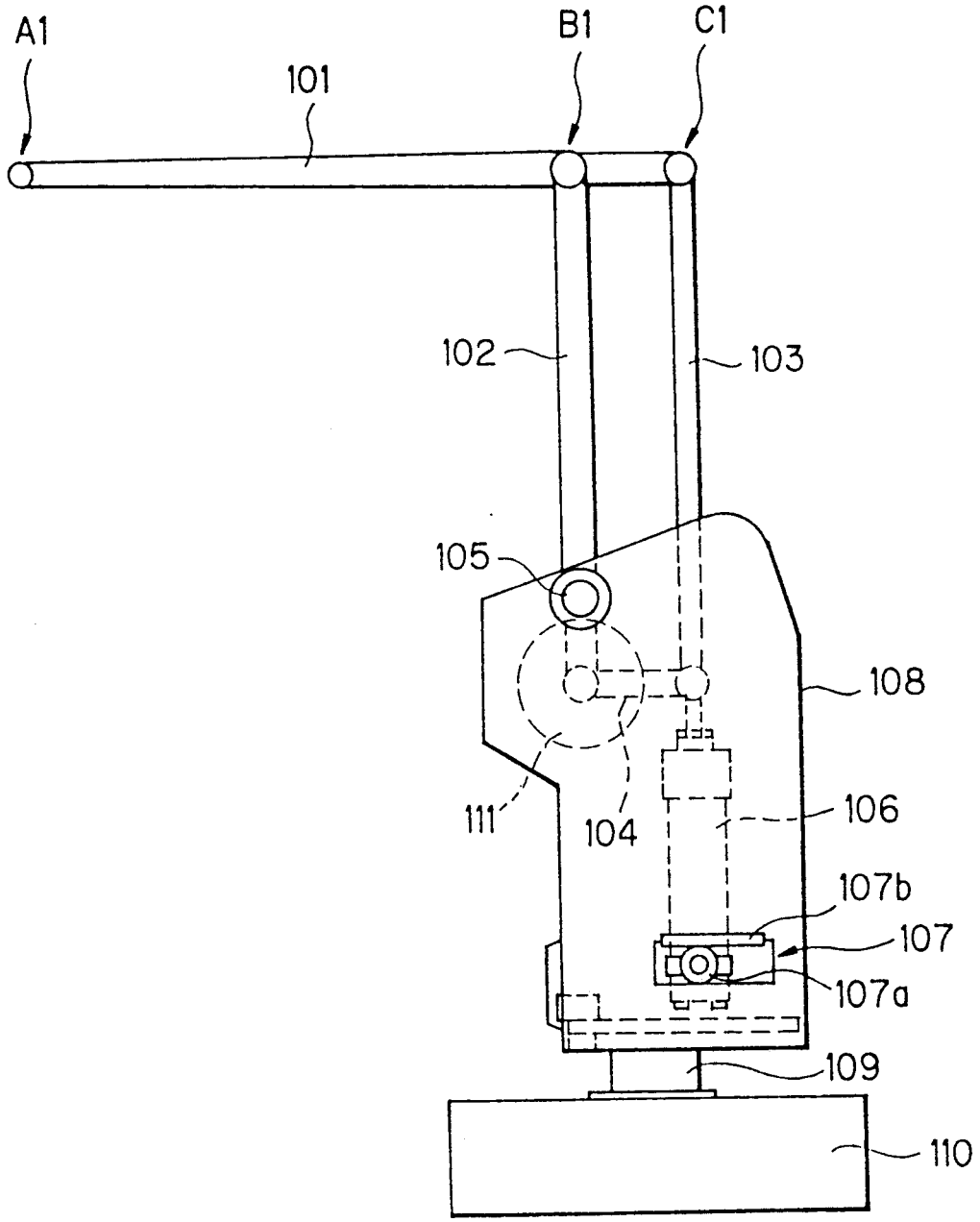
FIG. 1 PRIOR ART
FIG. 1 is an elevation view of a conventional apparatus for practice of ambulation.

Before explaining the preferred embodiments according to the invention, the conventional apparatus for practice of ambulation described in the afore-mentioned Japanese Utility Model Kokai No. 63-96014 will be explained. FIG. 1 shows the conventional apparatus for practice of ambulation. The apparatus has a main body 108 supported by a pole 109 fixed to a base 110. A patient is suspended by a suspending arm 101 at the point A1. Two upright rods 102 and 103 are connected at points B1 and C1 to the proximate portion of the suspending arm 101. A short rod 104 is connected to the lower ends of the upright rods 102 and 103 so that the four members 101, 102, 103 and 104 form a parallelogram. The upright rod 102 is pivoted around the axle 105 so as to permit the rod to rotate in the vertical plane including the suspending arm 101. The other upright rod 103 is connected at the lower end to a piston/cylinder unit 106 for pulling down the rod 103 vertically by means of a piston included herein. A pin 107*a* attached to the piston/cylinder unit 106 is capable of sliding along the guide rail 107*b*. Therefore, the piston/cylinder unit 106 is permitted to shift horizontally when the suspending arm 101 is caused to shift longitudinally to enforce the upright rod 103 to incline, by means of a guide rail 107*b* and a pin 107*a* sliding along the guide rail 107*b*. The main body 108 of the apparatus, thus the suspending arm 101 suspending the patient, is rotatable around the pole 109 so that the patient suspended by the apparatus can walk around the apparatus, i.e. transverse to the suspending arm 101.

An apparatus for practice of ambulation of the first embodiment according to the invention will be explained in detail.

Figure 2:
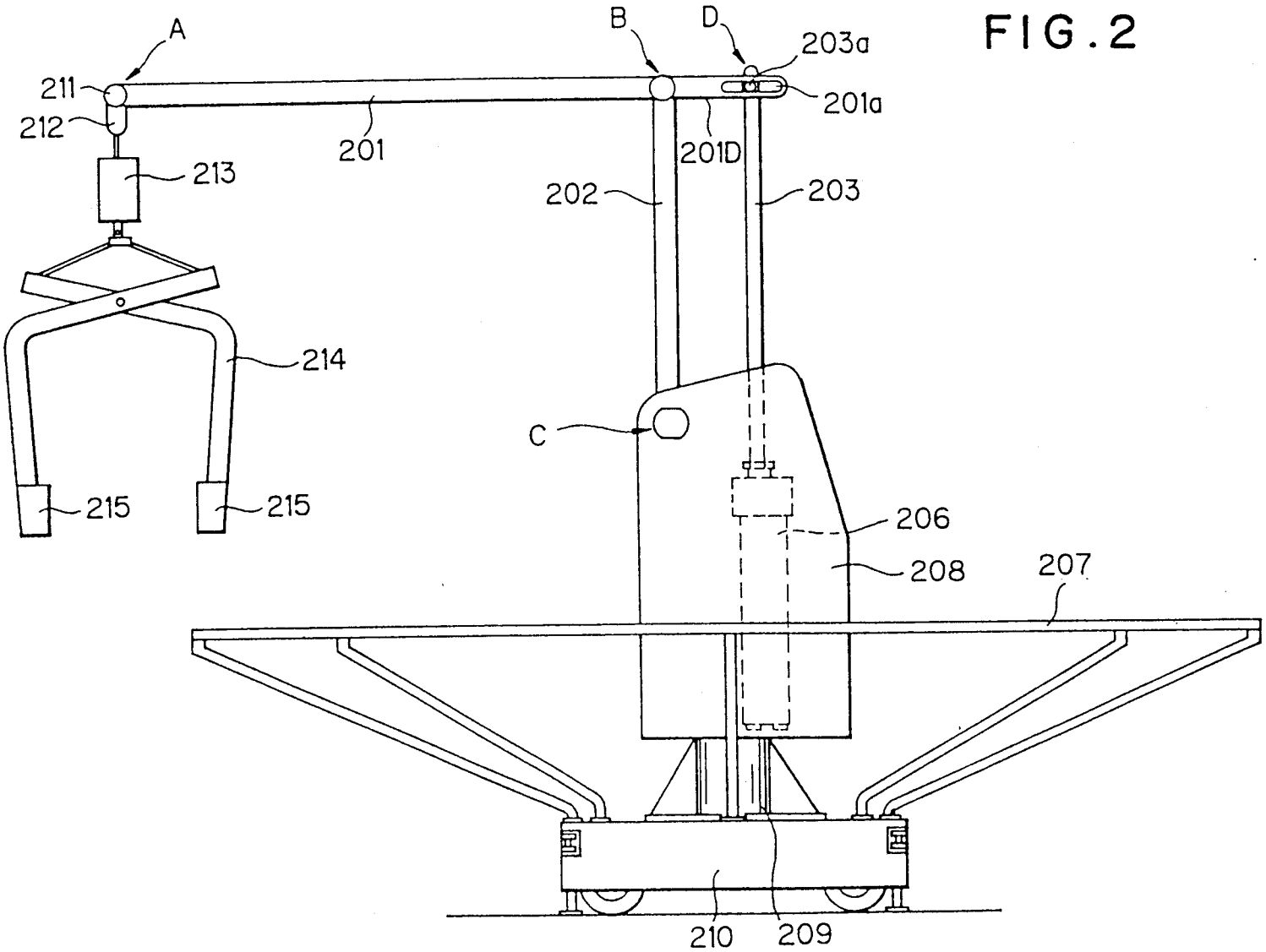
FIG. 2 is an elevation view of an apparatus of a first embodiment of the invention.
Figure 6:
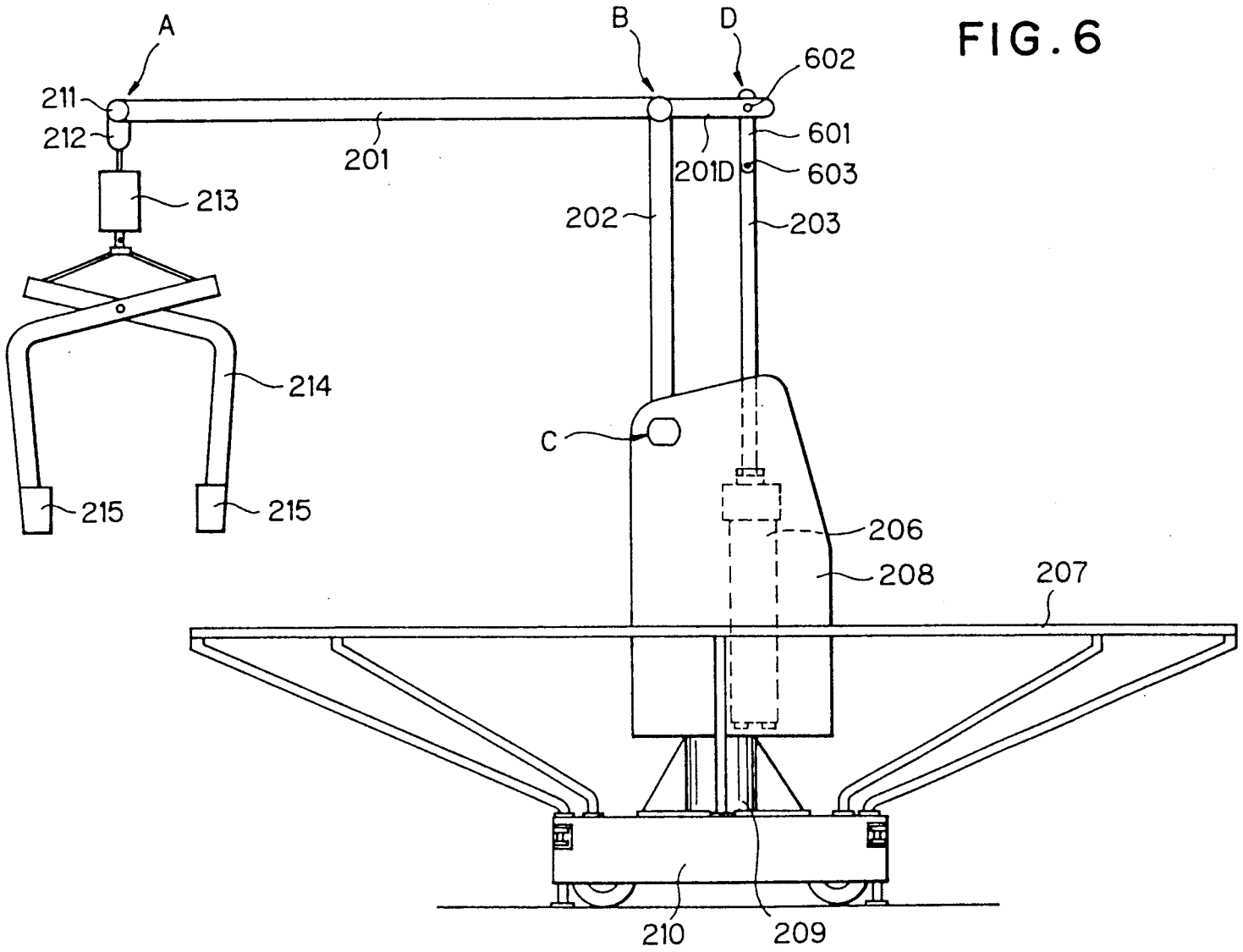
FIG. 6 is an elevation view of the apparatus of a third embodiment of the invention.

In FIG. 2 there is illustrated an apparatus for practice of ambulation which comprises a pole 209 fixed to a carrying cart 210, a main body 208 supported by the pole 209 rotatably around the same, a handrail 207 fixed to the carrying cart 210, surrounding the main body 208 so that the ambulation practice can be carried out along the handrail 207, a supporting rod 202 and a vertical rod 203 extending from the main body 208, and the suspending arm 201 supported by the supporting rod 202 at fulcrum B. The supporting rod 202 is fixed at point C to the main body 208. The vertical rod 203 is engaged to the proximate portion 201D of the suspending arm 201 at point D. The proximate portion 201D is provided with a slit 201*a* in which a pin 203*a* fixed to the vertical rod 203 slides. The vertical rod 203 is connected at the lower end to a piston, not shown in FIG. 2, contained in a piston/cylinder unit 206 fixed to the main body 208. Flexible joints may be provided at point D in place of the slit 201*a* and the pin 203*a*. Such an embodiment is shown in FIG. 6 and explained afterwards. The suspending arm 201 is provided with a hinge member 211 at point A, where an adjusting member 212 is mounted for adjusting the level of a suspending member 214 which is provided with armpit supporting members 215, 215 adapted to contact with armpits of the patient. A load sensor 213 is provided between the suspending member 214 and the adjusting member 212 for detecting the load based on the suspended patient.

Figure 3A:
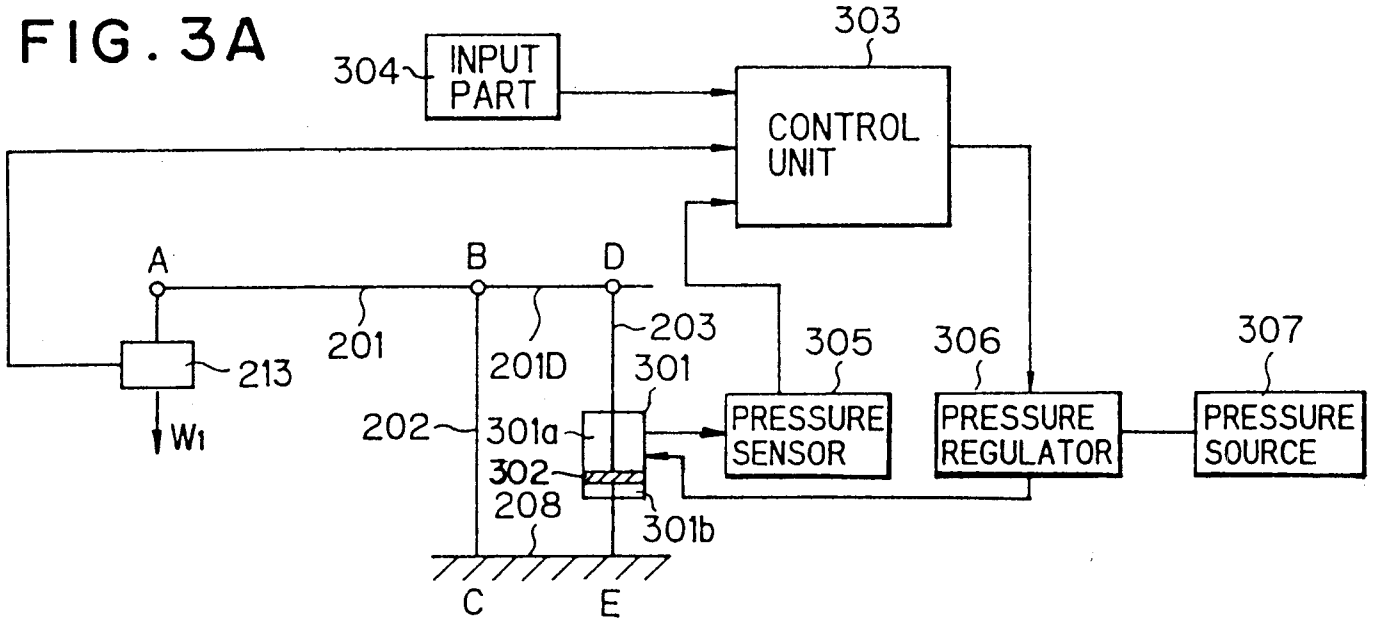
FIG. 3A and FIG. 3B are explanatory diagrams illustrating the operation of the apparatus of the first embodiment.

FIG. 3A is an explanatory view illustrating the operation of the apparatus of the first embodiment of the invention described above. The supporting rod 202 is fixed at point C to the main body 208. The vertical rod 203 is connected at its lower end with a piston 302 contained in the cylinder 301. Above the piston 302, the cylinder 301 provides a pressure chamber 301*a* connected through a pressure sensor 305 and a pressure regulator 306 to a pressure source 307 filled with compressed air. The pressure in the chamber is monitored by means of a pressure sensor 305. The lower chamber 301*b* opposite to the pressure chamber 301*a* is open to the atmosphere. The signals from the pressure sensor 305 and the load sensor 213 are supplied to a control unit 303, which provides a pressure of predetermined level to the regulator 306 to control the pressure in the pressure chamber 301*a* of the cylinder 301, based on the predetermined maximum value of suspending force supplied previously from the input part 304 and the measured values from the pressure sensor 305 and the load sensor 213.

The operation of the apparatus described above is explained in the following.

At first, the patient or a helper sets the value instructing the maximum value of the suspending force, usually the value equal to or less than the weight of the patient, by way of ten-keys (not shown in the drawings) or the like in the input part 304. The patient is suspended by the suspending member 214 with the force of controlled level not greater than this maximum value. The predetermined maximum value of suspending force is preferable to be smaller than the body weight of the patient, for example, 80% of the body weight of the patient. The control unit 303 compares a signal from the load sensor 213 with the limit of suspending force thus stored. If the former is not greater than the latter, the control unit 303 provides a predetermined value of pressure to the pressure regulator 306 so that a suspending force based on the pressure in the pressure chamber 301*a* within the cylinder 301 is applied to the vertical rod 203. The weight of the walking patient is shared by the suspending arm 201 in part and by the walking patient for the rest.

Figure 3B:
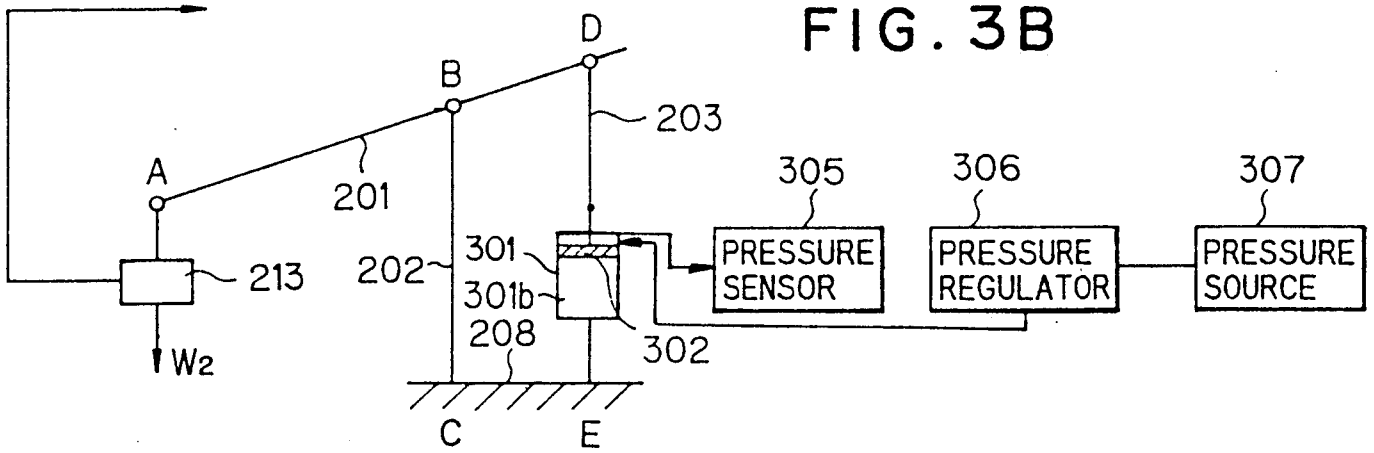

If the share of the weight supported by the patient is reduced, for example, when the patient stumbles, the weight shared by the suspending arm 201 increases from $W_1$ to $W_2$ This increase $W_2-W_1$ causes the suspending arm 201 to rotate anti-clockwise around point B by a small angle, as shown in FIG. 3B, because the system has been balanced for $W_1$ At the same time, the increase $W_2-W_1$ of the weight shared by the suspending arm 201 is detected by the load sensor 213. A signal of the detected amount of force $W_2$ is supplied to the control unit 303 and compared with the predetermined maximum value $W_0$ by a comparator. As far as the former is smaller than the latter, a signal depending on the difference between them is generated in the control unit 303 and given to the pressure regulator 306. In response to the signal, the pressure regulator 306 raises the pressure in the chamber 301*a* in the cylinder 301 so as to increase the force applied to the vertical rod 203, rotating clockwise the suspending arm 201 so as to restore the arm to the horizontal state. In case that the patient stumbles or falls down during walking, an extra-ordinary great force exceeding the entire body weight is exerted on the suspending member 214 and detected by the load sensor 213, resulting in a signal indicating the load greater than the predetermined maximum set value such as 80% of the patient's body weight to be transmitted to the control unit 303. The control unit 303 emerges an alarm and locks the suspending force at the limit in order to avoid the danger of lifting the patient with an excessive force.

Figure 4:
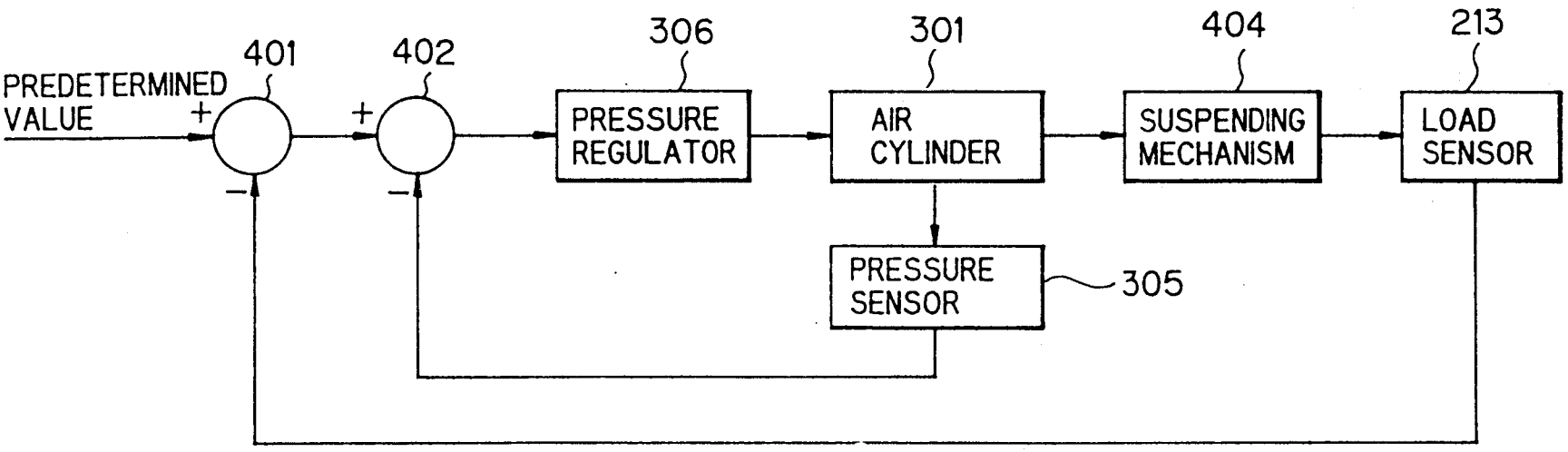
FIG. 4 is a block diagram of a control loop in the apparatus of the first embodiment.

FIG. 4 shows the control loop in the apparatus shown in FIG. 2. The load detected by the load sensor 213 is compared with the predetermined value the patient has set, by a first comparator 401. As long as the detected load is less than the predetermined value, the comparator 401 supplies pressure signal according to the difference between these values to a second comparator 402, which compares the pressure signal with the pressure detected by and transmitted from the pressure sensor 305. Based on this comparison and by way of computation, the pressure in the air cylinder 301 is controlled by the pressure regulator 306. Provided the value detected by the load sensor 213 is not less than the predetermined maximum level of suspending force, the pressure in the air cylinder 301 is locked to the limited level, by way of computation in the comparator 401, which corresponds to the predetermined maximum level of load set previously so as to avoid excessive suspension.

In another embodiment, the load sensor 213 may be inserted between the engaging member 203*a* and the suspension actuating rod 203 or between the rod 203 and the piston 302. The absolute value of load, either detected or predetermined, is different, of course, from that in the first embodiment.

Figure 5:
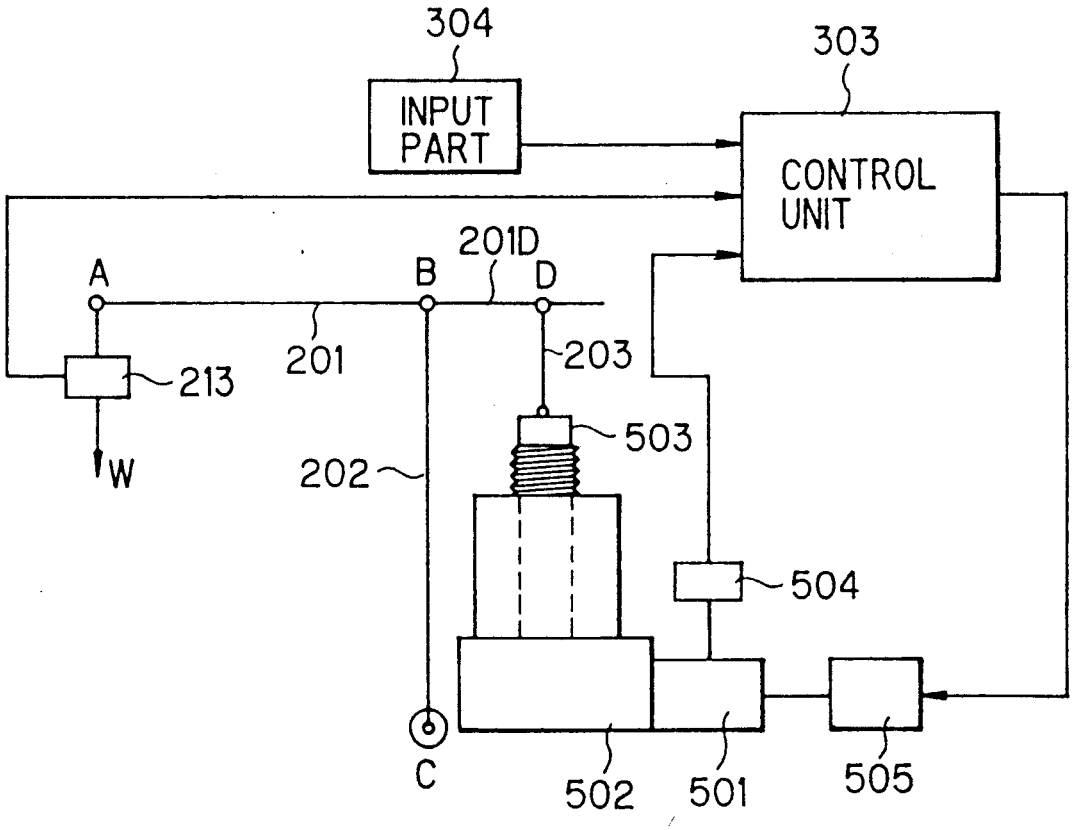
FIG. 5 is an explanatory diagram of a second embodiment of the invention.

FIG. 5 shows the second embodiment of the invention, in which components similar to those in FIG. 2 are indicated by the same reference numerals as in FIG. 2 and not explained again. In this embodiment, the cylinder 301 is replaced by a driving screw 503 combined with a motor 501 which causes the driving screw 503 to rotate through a reducer 502 for reducing the rotation speed of the motor 501, so as to move vertically the suspension actuating rod 203 which is engaged to the driving screw 503. The torque of the motor 501 is detected by a torque sensor 504. The relation between the detected torque and the load detected by the load sensor 213 determines the energizing of the motor 501 by way of a driver 505. Assuming the torque sensor 504 to be a pressure sensor 305 and the driver 505 to be a pressure regulator 306, the control loop of FIG. 3 could apply to this embodiment.

In the preferred embodiments of the invention described above, an apparatus for practice of ambulation is provided which prevents the patient from the danger when the weight carried by the apparatus is abruptly increased, as can happen when the patient stumbles or falls.

Figure 7:
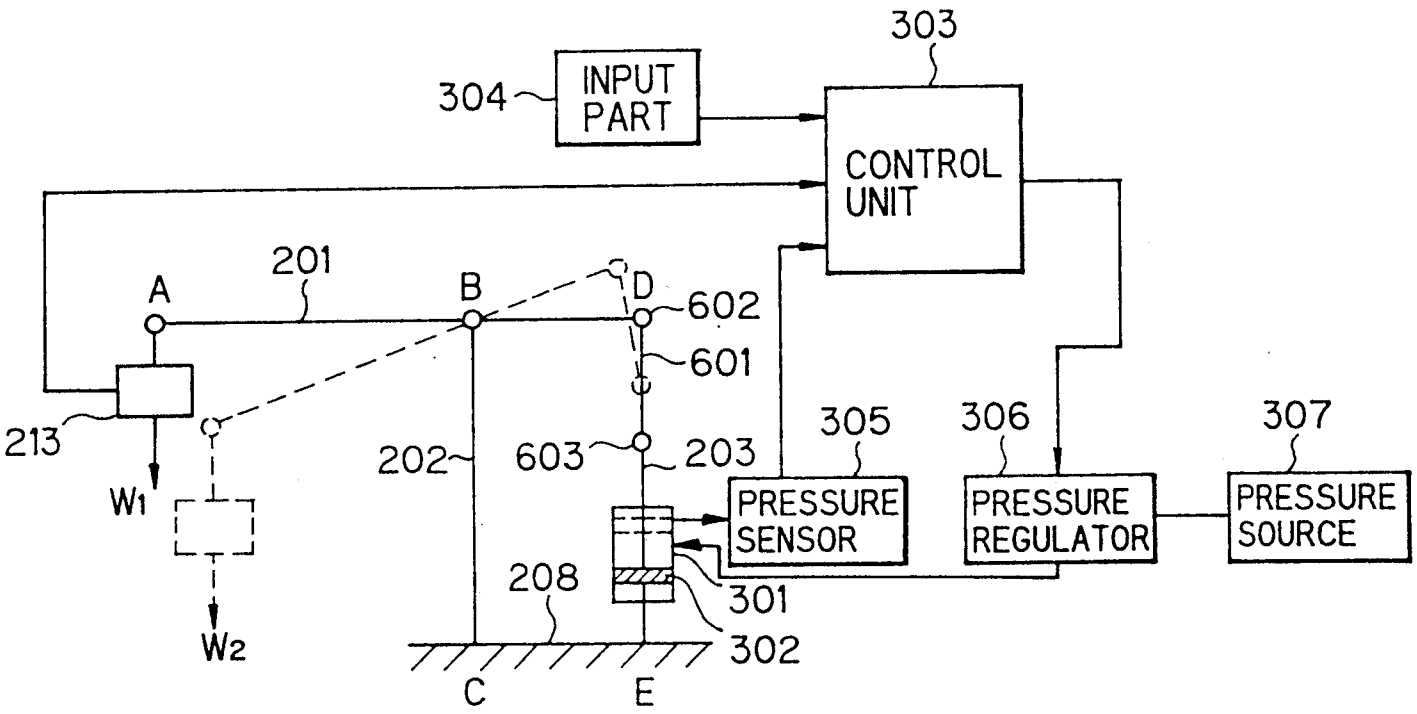
FIG. 7 is an explanatory diagram of the third embodiment of the invention.

The third embodiment of the invention is shown in FIG. 6 and FIG. 7, in which the engaging means is a rod provided with flexible joints, respectively, connected to the suspending arm and the vertical rod. The suspending arm 201 is connected to the vertical rod 203 by way of a connecting rod 601. The connecting rod 601 is provided with two flexible joints 602 and 603 at the ends. The joint 602 is engaged with the terminal D of the suspending arm 201. The joint 603 is engaged with the upper end of the vertical rod 203. Other components are similar to those shown in FIG. 2 and FIG. 3A. In FIG. 7, the solid lines show the states where the suspending arm 201 is kept horizontal with the load $W_1$, and the phantom lines show the states where the suspending arm 201 is inclined with the increased load $W_2$.

The operation of the apparatus shown in FIG. 6 and FIG. 7 is as follows. With the load $W_1$ the suspending arm 201 is assumed to balance. The connecting rod 601 is positioned vertically in this state. When the load increases to $W_2$, the pressure in the pressure chamber is less than that a value which keeps the balance, thus the suspending arm 201 is forced to rotate anti-clockwise to be inclined with the right end up. The end D of the suspending arm 201 pulls up the connecting rod 601 by way of the flexible joint 602, and thus the vertical rod 203 connected thereto by way of the flexible joint 603 is pulled up, causing the piston 302 to be pulled up. As the point D moves on a circle around the fulcrum B while the vertical rod 203 moves simply on a vertical line, the connecting rod 601 is allowed to incline by virtue of the flexible joints 602 and 602. The increase of the load $W_1$ to $W_2$ is detected by the load sensor 213. In accordance with the load signal, the pressure in the pressure chamber 301*a* above the piston 302 is increased so as to pull down the piston and restore the suspending arm 201 to be the horizontal position. In this instance again, the vertical motion of the vertical rod 203 is converted to the pivoting motion of the suspending arm 201 around the fulcrum B.

A described above, according to the invention, an apparatus for practice of ambulation is provided in which an arm for suspending the patient at a point in the distal portion is supported at a fulcrum, a suspension force is conveyed to the suspending arm in the proximate portion. The patient suspended by the apparatus is prevented from wobbling, because the suspending arm is prevented from longitudinal shift. The apparatus of the invention is, therefore, superior to conventional apparatus which permit the wobbling of the patient. In addition, the apparatus of the invention is simple and can be manufactured at less cost than the conventional apparatus. In a preferred embodiment, the suspending force is controlled in response to the load based on the weight of the patient shared by the suspending arm, therefore the patient is suspended with a force of an appropriate level. In the preferred embodiment, the patient is prevented from the danger of sudden lifting when the weight carried by the apparatus is abruptly increased, as can happen when the patient stumbles or falls.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. An apparatus for practice of ambulation by a patient, comprising:

a pivotable suspending arm having a distal end portion, said distal end portion having an end point to which the weight of the patient is applied, and a proximate end portion;

means for producing a force which causes said suspending arm to balance against a load based on the weight of the patient;

a vertical rod positioned between said suspending arm and said force producing means and actuated by said force producing means to move in a vertical direction; and means for operatively engaging said vertical rod with said suspending arm in said proximate portion thereof;

wherein said engaging means having a fulcrum, and said engaging means is constructed to convert a vertical motion of said vertical rod into a pivoting motion of said suspending arm around said fulcrum so as to convey the force applied to said vertical rod by said force producing means to said suspending arm without horizontal shift of said vertical rod.

2. An apparatus as defined in claim 1, wherein;

said fulcrum and said end point of said distal end portion of said suspending arm are positioned at two opposite sides of said suspending arm.

3. An apparatus as defined in claim 1, wherein;

said engaging means further comprises a slit bored along said suspending arm and a pin operatively fixed to said vertical rod.

4. An apparatus as defined in claim 1, wherein;

said engaging means includes a rod with flexible joints, respectively, operatively connected to said suspending arm and to said vertical rod.

5. An apparatus as defined in claim 1, further comprising:

means for detecting a load applied to said suspending arm at said point to produce a corresponding load signal; and means for controlling said force producing means to produce said force so that the force in an amount related to the detected load is produced upon receiving said load signal from said detecting means.

6. An apparatus as defined in claim 5, wherein;

said controlling means is constructed to limit an increase of the suspension force when the detected load exceeds a predetermined value.

7. An apparatus as defined in claim 6, wherein;

said predetermined value is of a predetermined percentage of the weight of said patient.

* * * * *